US011428245B2

(12) United States Patent
Luo et al.

(10) Patent No.: US 11,428,245 B2
(45) Date of Patent: Aug. 30, 2022

(54) CLIP FAN FOR PLANT TENT

(71) Applicant: Sinowell (Shanghai) Co., Ltd., Shanghai (CN)

(72) Inventors: Jia Luo, Shanghai (CN); Yan Yang, Shanghai (CN)

(73) Assignee: Sinowell (Shanghai) Co., Ltd., Shanghai (CN)

( * ) Notice: Subject to any disclaimer, the term of this patent is extended or adjusted under 35 U.S.C. 154(b) by 298 days.

(21) Appl. No.: 16/896,274

(22) Filed: Jun. 9, 2020

(65) Prior Publication Data

US 2020/0300267 A1 Sep. 24, 2020

(51) Int. Cl.
*F04D 29/64* (2006.01)
*F04D 19/00* (2006.01)

(52) U.S. Cl.
CPC ..... *F04D 29/646* (2013.01); *F04D 19/002* (2013.01); *F05B 2240/91* (2013.01)

(58) Field of Classification Search
CPC .... F04D 29/646; F04D 19/002; F04D 29/601; F05B 2240/91
See application file for complete search history.

(56) References Cited

U.S. PATENT DOCUMENTS

| | | | | |
|---|---|---|---|---|
| 3,131,449 | A * | 5/1964 | Iida | D06F 55/02 24/334 |
| 4,277,864 | A * | 7/1981 | Orson, Sr. | A44B 99/00 24/342.1 |
| 4,813,107 | A * | 3/1989 | Cetrone | A61B 17/1227 24/489 |
| 7,766,313 | B2 * | 8/2010 | Panosian | B25B 5/06 269/95 |
| 8,356,784 | B2 * | 1/2013 | Doll | F16M 13/022 248/316.1 |
| 2003/0037812 | A1 * | 2/2003 | Stewart | E04H 1/1277 135/96 |
| 2014/0273606 | A1 * | 9/2014 | Peterson | H01R 4/24 439/391 |
| 2020/0077827 | A1 * | 3/2020 | Andersen | A47G 33/10 |

* cited by examiner

*Primary Examiner* — Igor Kershteyn
(74) *Attorney, Agent, or Firm* — CBM Patent Consulting, LLC

(57) ABSTRACT

A clip-on fan includes a specialized clamping clip 56 that is attached to rectangular or cylindrical tent poles that are commonly used for grow tents; wherein fans are essential components for growing in tents and the current designs clip-on fans do not meet the needs of indoor growers; the clip-on fan comprising a fan assemblage and clip clasp assemblage arranged at the base of the complete product, wherein the clip 5 is able to grasp to the vertical tubular structure of a grow tent; the grasping clasp 5 assembly consisting of: a left clip plate 51, a right clip plate 52, a clip plate rotation shaft 53, a clip spring 54, a fan connection hole 55 and, a clip clamp opening 56; the left and right clip plates are connected in a bilateral symmetry through the clip plate rotation shaft at the central connection position.

3 Claims, 4 Drawing Sheets

CLIP FAN FOR PLANT TENT

This application claims priority to Chinese Patent Application Ser. No. CN2019206509969 filed on 8 May 2019.

TECHNICAL FIELD

This invention relates to indoor planting, indoor agriculture, small-scale indoor growing, dispersing heat and humidity in particular for indoor plant tents.

BACKGROUND OF THE INVENTION

In the field of indoor planting, a planting tent generally has a frame made of round or square steel or aluminum pipes. The frame is sleeved with a layer of Oxford cloth with a reflective film on the inside layer. Growers use artificial lights (such as LEDs) to simulate the sun and to promote the growth of plants inside the tent. In order to ensure photosynthesis and proper respiration during plant growth, it is necessary to ensure that air inside tent is effectively circulated and thus it is necessary to provide a fan for ventilation. Generally, the current clip-style fans have a flat clip that is appropriate for desks and other tabletops and are therefore unable to clip to tent poles. For example, the Chinese patent application CN103185012A and the Chinese patent 206017224U disclose a clip fan, and the US design patent D865,937S discloses a portable clip fan, wherein each clamping mechanism is designed for clipping to a tabletop. The aforementioned clamping mechanism can only be clamped on horizontal surfaces, not on vertical rods, thereby limiting the uses.

In order to address the needs of indoor planting and growing, the design outlined herein addresses horticultural needs for fans able to clip on vertical rounded or rectangular poles.

SUMMARY OF THE INVENTION

The technical objective of the invention explained herein is to address and overcome the defects of previous clip-on fan designs when used in growing tents.

To achieve said objective, a clip for a fan has been designed, which includes: A fan assemblage and clip clasp assemblage arranged at the base of the complete product, wherein the clip 5 is able to grasp to the vertical tubular structure of a grow tent; The grasping clasp 5 assembly consists of: a left clip plate 51, a right clip plate 52, a clip plate rotation shaft 53, a clip spring 54, a fan connection hole 55 and, a clip clamp opening 56. The left and right clip plates are connected in a bilateral symmetry through the clip plate rotation shaft at the central connection position. The clip plate rotation shaft is attached with a clip spring. The fan connection hole is situated above the clip plate rotation shaft. One end of the left clip plate and one end of the right clip plate serve to clamp and grasp to the tent pole while the other ends of the left and right clip plates form the leverage against the clip spring that opens the clip. The fan assemblage consists of: a motor cover 1, a micro motor 2, fan blades 3, a fan support and rotation rod 4. The micro motor is located inside the motor cover, the fan support and rotation rod is a distal attachment to the body of the motor and protrudes through a small opening in the motor cover; attached to the exposed end of the fan support and rotation rod is a single piece of multiple fan blades made of molded plastic or metal. This fan blade piece is attached to the fan support and rotation rod via a small hole in the ventral side of the fan blade piece.

The fan clip is designed to fit both cylindrical or square rods or planes. This is achieved with a rubber grip pad inside the clip that attaches to the tent pole while the plastic housing for the rubber grip is cylindrical in shape to match the shape of tent poles.

This invention is suitable for a wider use of scenarios and can be clamped to a circular or square rod as well as a flat plane surface and addresses the particular design needs of indoor tents and indoor planting.

1—motor cover; 2—micro motor; 3—blades; 4—fan support rod; 5—clip clasp assembly; 51—left clip plate; 52—right clip plate; 53—clip plate rotating shaft; 54—clip spring; 55—fan connection hole; 56—clip clasp opening.

DETAILED DESCRIPTION OF THE PREFERRED EMBODIMENT

The technical solution of the present invention will be further described with reference to the accompanying drawings and embodiments, and it is believed to be clear to those skilled in the art upon a reading of the following description in conjunction with the drawings.

As shown in FIGS. 1 through 6, a clip fan is comprised of a fan assemblage and a clip clasp assemblage arranged at the bottom end of the fan assembly.

Figure 1:
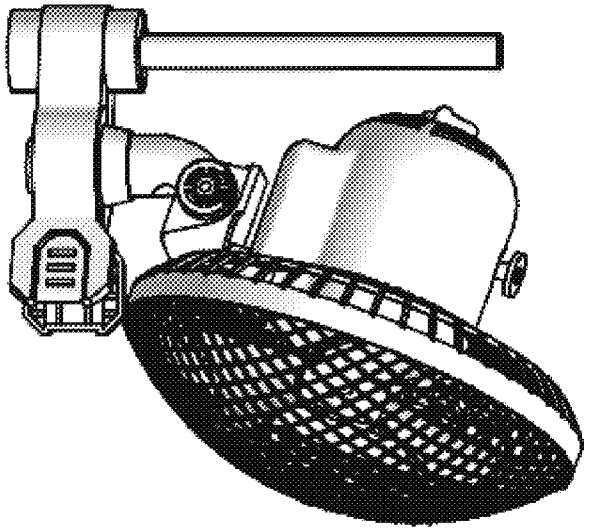
FIG. 1 is a stereogram of an overall structure of a clip fan of the present invention.
Figure 2:
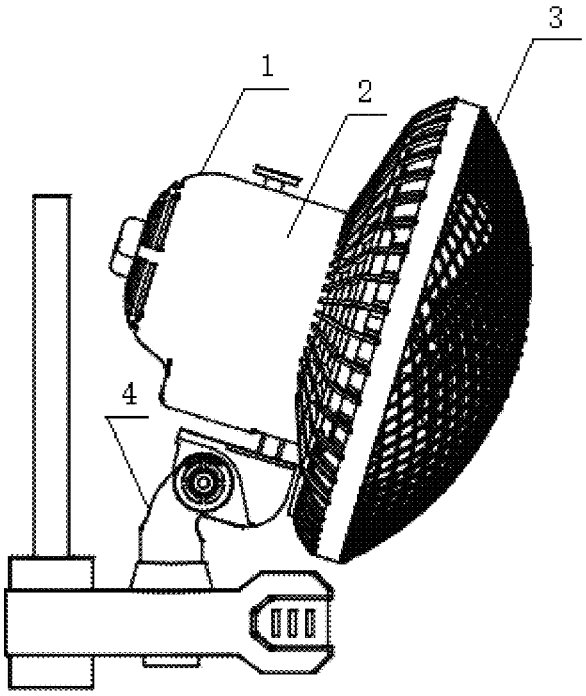
FIG. 2 is a main view of the overall structure of the clip fan of the present invention.
Figure 3:
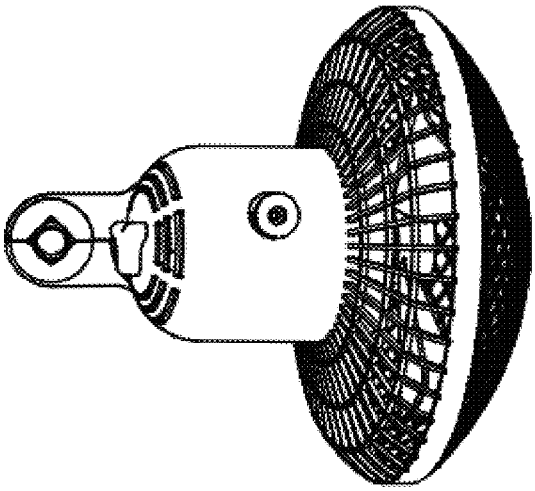
FIG. 3 is a top view of the overall structure of the clip fan of the present invention.

As shown in FIGS. 1 through 3, the fan assemblage consists of a motor cover 1, a micro motor 2, blades 3 and a fan support rod 4; the micro motor 2 is arranged inside the motor cover 1; the fan support rod 4 is fixed at the lower end of the motor cover 1; and the lower end of the fan support rod 4 is fixed with the fan connection hole 55 in the clip clasp assembly.

Figure 4:
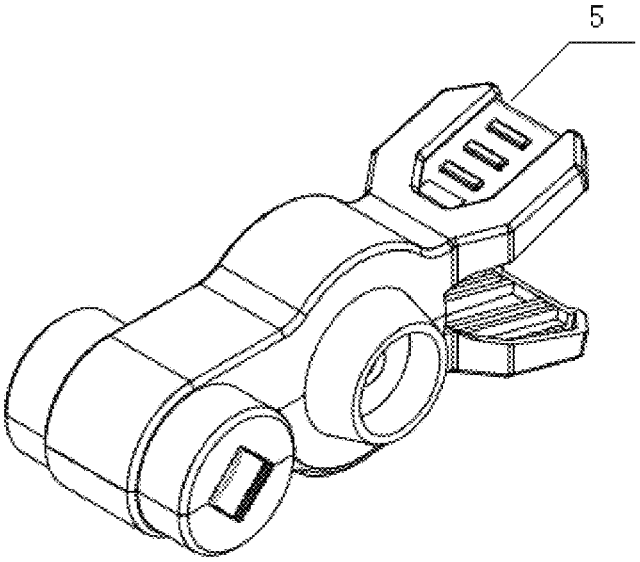
FIG. 4 is a stereogram of a clip clasp of the present invention.
Figure 5:
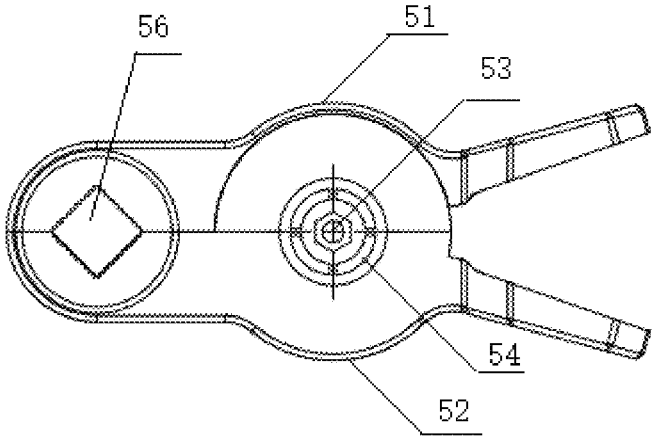
FIG. 5 is a top view of the clip clasp of the present invention.
Figure 6:
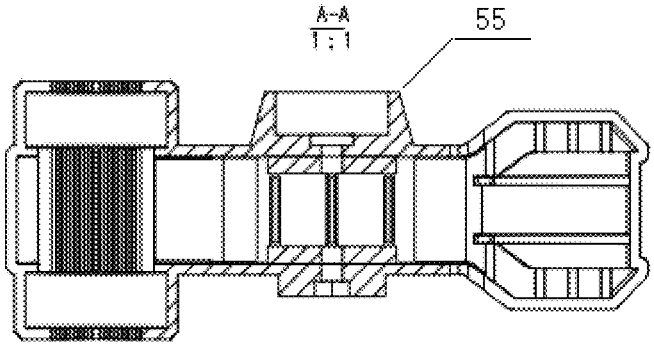
FIG. 6 is a side sectional view of the clip clasp of the present invention. In drawings, the reference symbols represent the following components.

As shown in FIGS. 4 through 6, the clip clasp assembly 5 consists of a left clip plate 51, a right clip plate 52, a clip plate rotating shaft 53, a clip spring 54, a fan connection hole 55, and a clip clamp opening 56; the left clip plate 51 and the right clip plate 52 are connected in a bilateral symmetry manner through the clip plate rotation shaft 53 is sleeved with the clip spring 54; the fan connection hole 55 is formed above the clip plate rotating shaft 53; one end of each of the left clip plate 51 and the right clip plate 52 serves as a clamping and holding part, and the other ends of the left clip plate 51 and the right clip plate 52 form a clip clasp opening 56 which is a square opening.

The diameter of the square opening is adapted to a cylindrical rod or a square rod or a plane.

A rubber pad is arranged at a clamping port of the clip clasp opening 56 of the left clip plate 51 and the right clip plate 52.

When in use, the clip fan of the present invention can be clamped conveniently on a round tube, a square tube or a flat table of the plant tent, so that a grower can fix the clip fan conveniently. Meanwhile, the fan can be angularly adjusted up and down, and can also rotate left and right, so that the fan can blow air to any position in the plant tent.

What is claimed is:

1. A clip fan for a plant tent, comprising a fan assembly and a clip clasp assembly arranged at the bottom of the fan assembly, wherein the plant tent has a frame composed of a tubular structure; the clip clasp assembly 5 consists of a left clip plate 51, a right clip plate 52, a clip plate rotation shaft 53, a clip spring 54, a fan connection hole 55, and a clip clamp opening 56; the left clip plate 51 and the right clip plate 52 are connected in a bilateral symmetry manner through the clip plate rotating shaft 53 at the middle connection position; the clip plate rotating shaft 53 is sleeved with the clip spring 54; the fan connection hole 55 is formed above the clip plate rotation shaft 53; one end of each of the left clip plate 51 and the right clip plate 52 serving as a clamping and holding part, and another end of the each of the left clip plate 51 and the right clip plate 52 forming the clip clasp opening 56 which is a square opening and can be clamped on the frame of the plant tent; and the fan assembly consists of a motor cover 1, a micro motor 2, blades 3 and a fan support rod 4; the micro motor 2 is arranged in the motor cover 1; the fan support rod 4 is fixed at the lower end of the motor cover 1; and the lower end of the fan support rod 4 is fixed with the fan connection opening 55 in the clip clasp assembly.

2. The clip fan for the plant tent according to claim 1, wherein the diameter of the square opening is adapted to a cylindrical rod or a square rod or a plane.

3. The clip fan for the plant tent according to claim 1, wherein a rubber pad is arranged at a clamping port of the clip clasp opening 56 of the left clip plate 51 and the right clip plate 52.

* * * * *